United States Patent [19]

Bierweller

[11] Patent Number: 4,478,162

[45] Date of Patent: Oct. 23, 1984

[54] NEEDLE GUARD OF A SEWING MACHINE

[75] Inventor: Gerhard Bierweller, Bielefeld, Fed. Rep. of Germany

[73] Assignee: Kochs Adler AG, Bielefeld, Fed. Rep. of Germany

[21] Appl. No.: 384,583

[22] Filed: Jun. 3, 1982

[30] Foreign Application Priority Data

Jun. 6, 1981 [DE] Fed. Rep. of Germany ..... 3122613
Apr. 3, 1982 [DE] Fed. Rep. of Germany ..... 3212543

[51] Int. Cl.[3] ..... D05B 55/06; D05B 57/08
[52] U.S. Cl. ..... 112/227; 112/228
[58] Field of Search ..... 112/227, 228; 411/81, 411/89, 114, 128

[56] References Cited

U.S. PATENT DOCUMENTS

| | | | |
|---|---|---|---|
| 1,271,935 | 7/1918 | Paul | 411/89 |
| 2,883,953 | 4/1959 | Johnson | 112/228 |
| 3,128,813 | 4/1964 | Davis et al. | 411/81 |
| 3,215,105 | 11/1965 | Kuhar | 112/228 |
| 3,955,519 | 5/1976 | Weisz | 112/228 |
| 4,094,261 | 6/1978 | Ketter et al. | 112/228 |
| 4,154,276 | 5/1979 | Wesner | 411/81 X |
| 4,278,038 | 7/1981 | Johnson | 112/228 |

FOREIGN PATENT DOCUMENTS

| | | | |
|---|---|---|---|
| 57-8077 | 1/1982 | Japan | 112/227 |

*Primary Examiner*—Wm. Carter Reynolds
*Attorney, Agent, or Firm*—Max Fogiel

[57] ABSTRACT

A needle guard of a double lockstitch hook of a sewing machine in which the needle guard is fastened at the rotatably pivoted hook body and the free end of the needle guard rests on a supporting screw. By turning the screw the position of the needle guard with respect to the beak of the hook may be adjusted. The procedure of adjustment may be carried out under actual conditions without taking the hook out of the sewing machine.

4 Claims, 5 Drawing Figures

Fig. 1
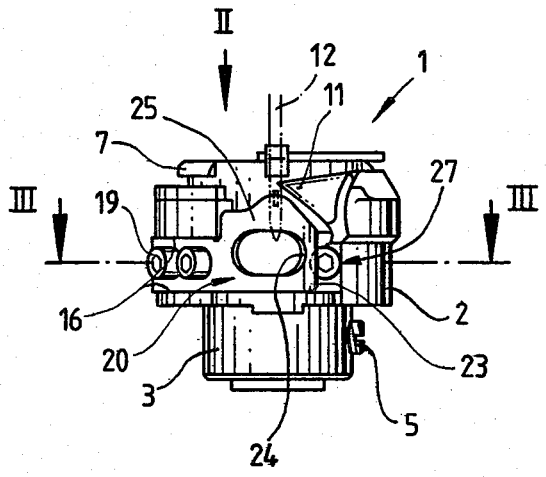
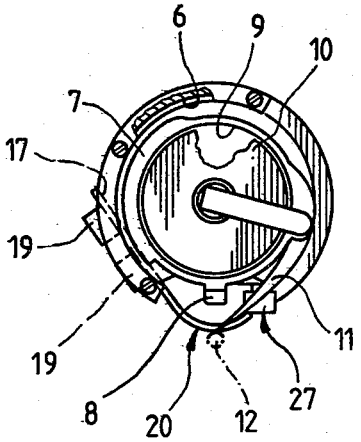
Fig. 2
Fig. 3
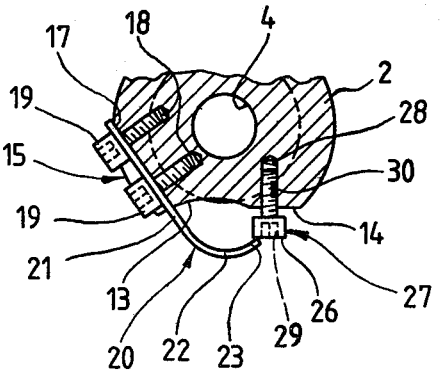

NEEDLE GUARD OF A SEWING MACHINE

BACKGROUND OF THE INVENTION

The present invention relates in general to a needle guard of a sewing machine installed with a double lockstitch hook having a rotatably pivoted hook body, with hook beak and a needle guard, one end of which is fastened by screws to the rotating hook body.

In U.S. Pat. No. 1,917,771 a type of such needle guard or needle guide is described wherein a needle guide is fastened with two screws at the circumference of the hook body. The other end of the needle guard extends with its free end into the area of the hook beak to prevent the needle, while penetrating in the workpiece, from collision with the hook beak, and to guide the needle.

Due to manufacturing tolerances of the hook body at the needle guard itself, and depending on the size of the needle, the needle guide of this type must be adjusted. This is achieved by bending the needle guide. Such a procedure of adjustment requires some skill at which the polished area of the needle guard as well as the polished hook beak must be prevented from any damage.

Moreover, in U.S. Pat. No. 2,866,425 there is presented a rotating double lockstitch hook installed with an adjustable needle guard. According to the description, the needle guard is adjustably fastened with screws at the undersurface of the hook body. As the complete hook is installed in a sewing machine, the screws for adjusting the needle guard are not accessible. Due to this kind of mounting, it is necessary to perform the procedure of adjustment of the needle guard with respect to the hook beak prior to the installation of the complete hook in the sewing machine for which additional auxiliary tools, e.g. a dial gauge (mechanical indicator) are required. When adjusting a needle guard of such type, one has to take care not to alter the adjustment as the screws fastening the needle guard to the hook body are tightened. Moreover, the manufacturing of a needle guard of such construction requires some effort.

Accordingly, it is the main object of the present invention to provide a needle guard for a double lockstitch hook of a sewing machine, which is simple in construction and simple to adjust under actual operating conditions as the hook is installed in the sewing machine.

A further object of the present invention is to install a needle guard with elements which make possible a fine adjustment that is easily accessible in the machine.

Still another object of the present invention is to provide a needle guard for a double lockstitch hook with adjustment means, which allow to easily make re-adjustment of the needle guard with respect to the needle and the hook beak.

A still further object of the present invention is to provide a needle guard of the aforegoing character which may be manufactured at low cost and is reliable in operation.

SUMMARY OF THE INVENTION

The objects of the present invention are achieved by arranging an adjustment screw in the hook body supporting the free end of the needle guard. With this feature it is possible to adjustably form a needle guard at low cost.

The installation of the adjustment screw allows to readjust the adjustment of a needle guard in any direction without exposing the needle guard and the beak of the hook to any damage. With the application of a self-locking screw as a commercially available item, a very low cost adjustment means is achieved.

Other objects, advantages and features of the present invention will appear from the detailed descriptions of the preferred and modified embodiments, which will now be explained in conjunction with the accompanying drawings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the drawings:

FIG. 1 is a view of the needle guard according to the invention, located at a double lockstitch hook;

FIG. 2 is a view of the double lockstitch hook in the direction of the arrow II in FIG. 1;

FIG. 3 is a section taken along line III—III of FIG. 1;

DESCRIPTION OF THE PREFERRED EMBODIMENTS

Figure 4:
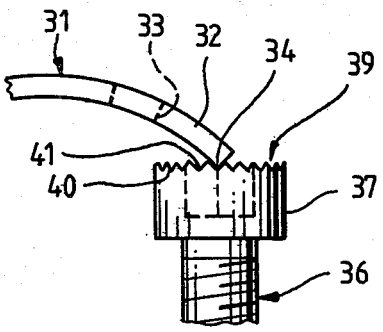
FIG. 4 is an enlarged view of a screw having a screw locking device according to the modified embodiment.

In FIG. 1 there is shown a hook 1 provided with a hook body 2, the lower part of which is formed with a hub 3 and a bore 4 (FIG. 3). In the hub 3 there are threads (not further denoted) for receiving setscrews 5,—one of the latter being illustrated in FIG. 1. The upper part of the hook body 2 is formed with a bearing or a bearing raceway 6 (FIG. 2) for pivotally receiving a bearing rib (not denoted) of a bobbin case 7. This arrangement is well known in the art. As the bearing raceway 6 is concentrically located with respect to an imaginable center line of the bore 4, the center line also represents the pivot point or the pivot axis of the bobbin case 7. The bobbin case 7 is provided with a radially extending nose 8, and inside with a recess 9 for pivotally receiving a thread supply carrying bobbin 10. Moreover, the hook body 2 is formed with a beak 11 cooperating with a needle 12.

Below the beak 11, the hook body 2 is provided there with a curved recess 13 (FIG. 3) terminating at one side in a surface 14 and at the other side in a U-shaped groove 15. The U-shaped groove 15 has two legs 16 (FIG. 1) and a surface 17 (FIG. 3) connecting the legs 16. The surface 17 is formed with two threads 18 for fastening a needle guard 20 by means of screws 19. The needle guard 20 comprises a straight part 21 in accordance with the U-shaped groove 15 and a curved part 22 having a free end 23. The curved part 22 is provided with a cut-out 24, from which extends upwardly a contact surface 25 (FIG. 1) for the needle 12.

As obvious from FIG. 3, the free end 23 of the curved part 22 of the needle guard 20 rests against the head 26 of a screw 27, which is received in a threadhole 28 located in the hook body 2. The head 26 of the screw 27 is formed with a female hexagon 29 and its thread is provided with a plastic coating 30.

Figure 5:
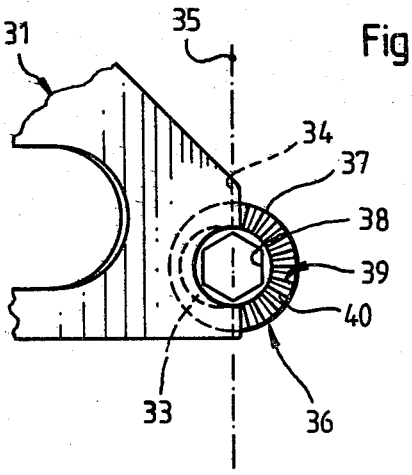
FIG. 5 is a view of the screw locking device in the direction of the arrow V in FIG. 4.

In a modified embodiment in FIGS. 4 and 5, there is illustrated a needle guard 31 which is of the same construction as the needle guard 20. However, it is formed at its free end 32 with a recess 33 and an edge 34 extending along a center line 35 of a screw 36. The screw 36 is provided with a head 37 formed with a female hexagon 38, and at its front end 39 with a toothing 40 having radially extending V-shaped recesses 41.

Operation of the needle guard according to the preferred embodiment may be described as follows:

When operating the sewing machine, the hook body 2 secured to a vertically arranged shaft by means of the setscrews 5 rotates, while the bobbin case 7 is kept stationary by the cooperation of the nose 8 and a recess (not shown) of the throat plate. The hook 1 is driven in a fixed ratio with respect to the needle 12, which, in the looptaking instant is in the position as illustrated in FIG. 1. As obvious from FIGS. 1 and 2, at this moment the needle 12 is in contact with the contact surface 25 of the needle guard 20, in order to stabilize on one hand the needle 12 in its position and on the other hand to prevent the needle 12 from colliding with the beak 11. Due to its construction and fastening to the hook body 2, the needle guard 20 is exposed to a pretension so that the free end 23 is constantly resting against the head 26 when tightening or loosening the screw 27 by an adjusted amount. When turning the screw 27 by means of a suitable wrench, the free end 23 of the curved part 22 and thus the contact surface 25 are displaced, so that there will be available more or less clearance between the needle 12 and the beak 11. The plastic coating 30 causes the screw 27 to be difficult in turn, thus favoring an exact adjustment and preventing a self-turning while the sewing machine is operating.

Operation of the needle guard according to the modified embodiment may be described as follows:

The needle guard 31 fastened to the hook body 2 is biased with its edge 34 to the front end 39, at which the edge 34 engages the V-shaped recesses 41 of the toothing 40 thus also securing the screw 36 against undesired rotation, i.e. getting out of adjustment. For adjustment, the screw 36 is turned at the female hexagon 38 by means of a socket screw key. The screw 36 may only be turned by the pitch of the toothing 40, at which the needle guard 31 may be brought tooth by tooth into another position by its edge 34. Due to the coaction of the edge 34 and the toothing 40, this embodiment is featuring a simple and effective fine adjustment making possible especially repeated settings.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement in a sewing machine, comprising: a double lockstitch hook with a rotatably mounted hook body, a hook beak and needle guard means having a free end; said needle guard means being attached by screw means to said hook body; and supporting screw means for said free end in said hook body and having means for securing said supporting screw means against undesired rotation, said hook body having a hub for receiving said supporting screw means, said hook body having an upper part formed with a bearing for pivotably receiving a bobbin case; said hook body having a curved recess below said beak and terminating at one side in a surface and at the other side in a U-shaped groove with two legs and a surface connecting said legs, said surface connecting said legs having threads for fastening said needle guard means; said needle guard means comprising a substantially straight portion corresponding to said U-shaped groove and a curved portion having said free end; said curved portion having a cut-out, a contact surface extending upwardly from said cutout for a needle; said supporting screw means being received in a threaded hole in said hook body and having a head, said free end of said curved portion of said needle guard means resting against said head, said needle guard means being pretensioned so that said free end rests constantly against said head when said supporting screw means is turned to vary the position of said needle guard means with respect to said beak, said free end and said contact surface being displaced upon turning said supporting screw means to provide substantial clearance between the needle and said beak, said means for securing said supporting screw means comprising a coating for preventing self-turning of said supporting screw means when the sewing machine is in operation, said hook remaining in the sewing machine when adjusting the position of said guard means relative to said beak by turning said supporting screw means; said needle guard contacting said needle in a most close vicinity of the hook beak.

2. A needle guard as defined in claim 1, wherein said supporting screw means and said means for securing said supporting screw means comprises a cylindrical screw with a female hexagon head and a threaded portion having said coating, said coating comprising plastic.

3. An arrangement in a sewing machine, comprising: a double lockstitch hook with a rotatably mounted hook body, a hook beak and needle guard means having a free end; said needle guard means being attached by screw means to said hook body and supporting screw means for said free end in said hook body and having means for securing said supporting screw means against undesired rotation, said hook body having a hub for receiving said supporting screw means, said supporting screw means received in a threaded hole in said hook body and having a head, said free end of said curved portion of said needle guard means resting against said head, said needle guard means being pretensioned so that said free end rests constantly against said head when said supporting screw means is turned to vary the position of said needle guard means with respect to said beak, said free end and said contact surface being displaced upon turning said supporting screw means to provide substantial clearance between a needle and said beak, said means for securing said supporting screw means comprising a coating for preventing self-turning of said supporting screw means when the sewing machine is in operation, said hook remaining in the sewing machine when adjusting the position of said guard means relative to said beak by turning said supporting screw means; said needle guard contacting said needle in a most close vicinity of the hook beak.

4. A needle guard as defined in claim 3, wherein said supporting screw means and said means for securing said supporting screw means comprises a cylindrical screw with a female hexagon head and a threaded portion having said coating, said coating comprising plastic.

* * * * *